United States Patent [19]

Pacini

[11] Patent Number: 4,635,407

[45] Date of Patent: Jan. 13, 1987

[54] TRUNCATED-CONE ROLLER WITH ABRASIVE SURFACE FOR SMOOTHING TOOL WITH RADIAL TRUNCATED-CONE ROLLER

[76] Inventor: Ermanno Pacini, Viale Boezio, 10, 20145 Milano, Italy

[21] Appl. No.: 596,949

[22] Filed: Apr. 5, 1984

[30] Foreign Application Priority Data

Apr. 27, 1983 [IT] Italy ..... 20810 A/83

[51] Int. Cl.[4] ..... B24B 33/00

[52] U.S. Cl. ..... 51/206 R; 407/57; 407/59; 29/79

[58] Field of Search ..... 51/206 R, 206 P, 206.4, 51/206.5; 407/57, 58, 59; 29/79

[56] References Cited

U.S. PATENT DOCUMENTS

| | | | |
|---|---|---|---|
| 1,359,179 | 11/1920 | Lassiter | 407/59 |
| 1,407,837 | 2/1922 | Buckingham | 407/59 |
| 2,115,209 | 4/1938 | Mulholland | 51/206 P |
| 2,207,909 | 7/1940 | Besaw | 407/59 |
| 2,633,778 | 4/1953 | Stuck | 51/206.4 |
| 3,154,894 | 11/1964 | Dawkins | 51/206 R |
| 3,510,990 | 5/1970 | Steindler | 51/206 R |
| 4,285,618 | 8/1981 | Shanley | 407/57 |
| 4,484,560 | 11/1984 | Tanigawa | 51/206.5 |

FOREIGN PATENT DOCUMENTS

| | | | |
|---|---|---|---|
| 2434714 | 2/1975 | Fed. Rep. of Germany | 51/206 R |
| 1006071 | 3/1983 | U.S.S.R. | 407/57 |

*Primary Examiner*—Harold D. Whitehead

*Attorney, Agent, or Firm*—Murray and Whisenhunt

[57] ABSTRACT

The abrasive surface of the roller has the shape of a continuous helix with variable pitch constituted by a succession of single abrasive plugs of similar characteristics and size.

7 Claims, 3 Drawing Figures

TRUNCATED-CONE ROLLER WITH ABRASIVE SURFACE FOR SMOOTHING TOOL WITH RADIAL TRUNCATED-CONE ROLLER

The present invention relates to a truncated-cone roller with abrasive surface, which is useful for the use in a smoothing tool with radial truncated-cone rollers, such as that described in the Italian patent application No. 24268 A/80 filed on Aug. 25, 1980 in the name of the same Applicant of the present application.

The above mentioned application has brought to the smoothing art (with this term comprising also, even if improperly, the roughing and the polishing) a basic change, represented by the realization of the tool in the shape of a rotating plate carrying a plurality of truncated-cone rollers radially disposed with respect to the rotation axis of the plate, with the minor base faced towards the same axis, that is towards the inside of the plate.

Said truncated-cone rollers constitute the abrasive elements which contact the material to be worked and consequently have an opportunely chosen abrasive surface, substantially based on the use of diamond grains held together by binding material.

For the realization of such abrasive surface it has been thought to make use of the already known technology for tools of other kinds, which employ a single cylindric roller rotated with its own axis perpendicular to the advancement of the material.

Said known technology in some cases provides for the use of single abrasive plugs or segments applied in different ways on the cylindric surface of the roller and alternated with hollow spaces according to a chessboard disposition with attack corners parallel to the rotation axis of the roller.

In other cases, on the contrary, the abrasive surface has the shape of a continuous helix with constant pitch obtained by electrolytic deposition.

None of such known solutions have been revealed satisfactory, above all in view of their use for truncated-cone rollers at radial disposition such as those of the tool of the above mentioned application.

The abrasive surface with single plugs presents in fact the disadvantage of involving a high number of impacts of the attack corners of the same plugs on the material to be smoothed, with consequent quick wear of the abrasive material, roller vibration transmitted to the transmission gear and bad finishing of the material to be worked.

Besides, as the attack corners of the single abrasive plugs are disposed perpendicularly to the rotation direction of the roller, their engagement with the material is absolutely lacking of transversal components able to send away from the zone of influence of the same plugs, and consequently from the roller, the mud gradually formed by the removed material and by the cooling water. So the plugs continue to mill the same mud, this resulting in a lower duration and in a lower abrading capacity of the abrasive.

The constant-pitch continuous-helix abrasive surface obtained by electrolytic deposition would be theoretically advantageous to the effect of the reduction of the impacts and of the elimination of the mud, as the oblique attack corner of the helix evidently creates transversal thrusts able to bring the mud out of the influence area of the cylinder. The used deposition technology is however cause of strong height limitations, which on one hand reduce the capacity of elimination of the mud and on the other hand cause a reduced duration of the abrasive.

Neither the above mentioned solution nor the other, substantially based on constant and regular distributions of the abrasive material, would be able to assure an uniform consumption of the same material on the whole surface of a roller radially disposed as in the tool of the above mentioned patent application. In fact, it is known that such a disposition causes a higher consumption of abrasive towards the periphery (where it first meets the material to be worked) rather than towards the center of the tool with consequent different wear of the abrasive surface.

Finally, in case of single plugs, it is not possible to neglect the considerable variety of shapes of the plugs, which would be given by the truncated-cone shape of the roller, this resulting into very strong production costs of the same plugs.

Considered the present priot art, the object of the present invention has therefore been that to create a new and original solution, which was specifically suitable for the truncated-cone rollers at radial disposition of the tolls realized according to the above mentioned patent application, particularly assuring very little impacts on the material, very good elimination of the mud, high duration and uniform consumption along the whole abrasive surface.

According to the invention such an object has been reached by means of a truncated-cone roller with abrasive surface, characterized in that said abrasive surface is realized in the shape of at least one variable-pitch continuous helix formed by a succession of single abrasive plugs of similar characteristics and size.

Many advantages can be found in the helix structure with consecutive identic plugs, which is provided for the abrasive surface of the roller according to the invention.

Above all, as the plugs of every helix follow each other without continuity solution, the impact with the surface of the material to be worked is limited only to the outer end (with maximum diameter) of the roller. The number of the impacts is thus extremely reduced to complete advantage of the duration of the abrasive material and of the same transmission members of the roller, as well as of the efficiency of the smoothing work.

Besides, still as consequence of the helix disposition, the several plugs have an oblique attack corner, which creates transversal force components able to help the emission of the mud from the work area. Also in these cases there are favorable effects on the duration and on the work capacity of the abrasive material.

On the other hand, the single abrasive plugs can be realized in the most appropriate thickness, so as to have high duration and maximum mud conveyance effect.

At the same time, it is extremely important the fact that the helix has a variable pitch, substantially minimum at the end of maximum diameter of the roller (that is that destined to face outwards of the tool) and maximum at the other end. In fact, this means to assure a suitable accumulation of turns of the helix, and consequently of the abrasive material, where it is more necessary because the consumption is higher. In such a way, the consumption of abrasive material can be made uniform for the whole surface of the roller.

It is finally decisive the fact that the shape of the helix is chosen so as to make possible the use of absolutely identical plugs. In fact this allows to realize all the plugs by means of a single mould with consequent suitable limitation of the cost of the plugs and finally of the roller.

The characteristics of the present invention will be made more evident by the following detailed description of an embodiment illustrated by way of example in the enclosed drawings, in which.

Figure 1:
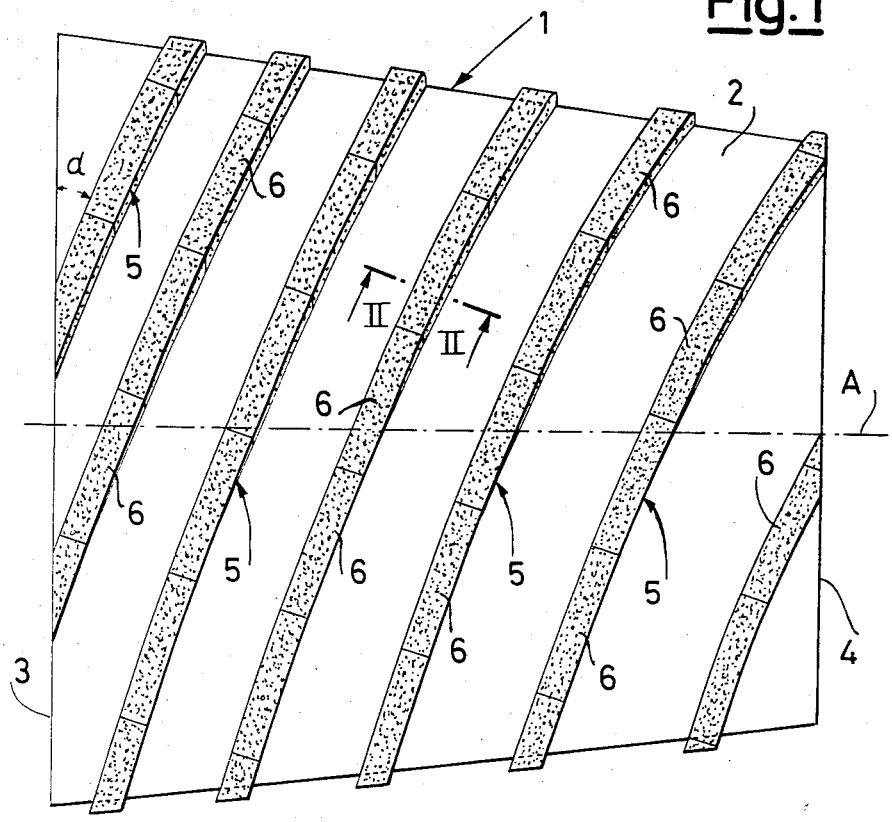
FIG. 1 shows a schematic plan view of a truncated-cone roller with variable-pitch abrasive helixes according to the present invention.

With reference to FIG. 1, there is shown a truncated-cone roller 1 with rotation awis A, which is destined for the use in a smoothing tool with rotating plate and truncated-cone radially disposed rollers (with larger base faced outwards) such as that described in the Italian patent application No. 24268 A/80 filed on Aug. 25, 1980.

The above mentioned roller is constituted by a truncated-cone body 2 with larger base 3 and smaller base 4, on which there is sticked a diamond-coated abrasive surface realized in the shape of a number of helixes with variable pitch 5, everyone constituted by a continuous succession of abrasive plugs 6 of identical characteristics and size.

The pitch of the single helix is made change from a minimum at the larger base of the roller to a maximum at the smaller base, so as to assure an uniform consumption of the abrasive, thereby compensating the differences otherwise due to the different intervention moments of the outer plugs (which work first) with respect to the inner plugs.

The helix variable pitch is obtained by making its inclination $\alpha$ change in a continuos way from a minimum at the larger base of the roller to a maximum at the lower base.

The variation law is chosen so as to assure, as already said, the absolute identity of characteristics and size of the single abrasive plugs.

Figure 3:
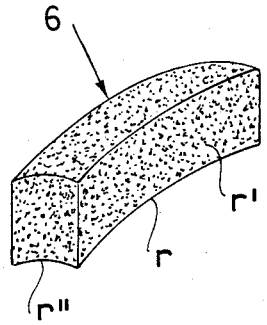
FIG. 3 shows in schematic perspective view the detail of the abrasive part of a plug of the roller of FIG. 1.

Called, with reference to FIG. 3, r the bending radius of the support base of the plug in the longitudinal direction, it is possible to demonstrate that the inclination of the helix must change so as to satisfy the following relation $$r=d/2(1+tg^2\alpha)=\text{constant}$$

where d is the diameter of the roller, variable from a maximum $d_M$ to a minimum $d_m$, with which the inclination $\alpha$ must change in opposite way.

Called r' the lateral bending radius of the same plug, the following relation must also be satisfied:

$$r' = \frac{180^\circ \cdot H}{\pi \cdot \sec\alpha \cdot (\alpha_M - \alpha_m)} = \text{constant}$$

where

H=axial length of the roller $\alpha_M$ and $\alpha_m$=maximum and minimum value, respectively of the inclination $\alpha$ of the two ends of the roller.

The relation $$\frac{360^\circ \cdot L}{\pi} \cdot \frac{\cos\alpha}{d} = \text{constant}$$

finally must be satisfied, where L=length of the plug.

On the contrary, it is possible to omit the possible changes of the transversal bending radius r'' of the support base of the plug because they are considered of minor value and therefore within the foreseen tolerances.

Figure 2:
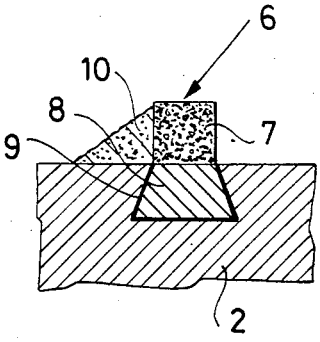
FIG. 2 shows a detail of the above mentioned roller in section along line II—II of FIG. 1.

The fixing of the plugs to the cylindrical body of the roller can be executed in different ways. One of these is illustrated by way of example in FIG. 2 and provides that the single plug is formed by a portion of abrasive material 7 (generally of diamond grains held together by means of a binder) and by a support portion 8 shaped as a dovetail and inserted and fixed (for example, stuck) in a corresponding groove 9 of the roller body. If desired, the face of the portion 7 which gets into contact with the material can be provided with a coating of inert material 10 able to reduce the resistance to the cooling water so as to correspondingly reduce the consumption of energy.

I claim:

1. A truncated-cone roller with abrasive surface for roughing, smoothing and polishing machines provided with a working tool rotatable about a vertical axis and including truncated-cone abrasive rollers radially disposed with respect to said vertical axis, wherein said abrasive surface consists of at least one variable-pitch continuous helix of abrasive material, said helix having a pitch which varies continuously from a minimum at the outer base to a maximum at the inner base of the roller.

2. A truncated-cone roller according to claim 1, wherein said variable-pitch helix is formed by a succession of single abrasive plugs of similar characteristics and size, arranged without solution of continuity.

3. Truncated-cone roller according to claim 2, characterized in that said helix has inclination which varies in continuous way from one end to the other of the roller according to the law $$r=d/2(1+tg^2\alpha)=\text{constant}$$

where d=diameter of the cylinder, $\alpha$=inclination of the helix, r=longitudinal bending radius of the support base of the helix.

4. Truncated-cone roller according to claim 3, characterized in that said helix inclination also satisfies the relation:

$$r' = \frac{180^\circ \cdot H}{\pi \cdot \sec\alpha \cdot (\alpha_M - \alpha_m)} = \text{constant}$$

where r'=lateral bending radius of the helix, H=axial length of the roller, $\alpha_M$ and $\alpha_m$=maximum and minimum inclination of the helix at the roller ends.

5. Truncated-cone roller according to claim 3, characterized in that the helix satisfies the relation:

$$\frac{360^\circ \cdot L}{\pi} \cdot \frac{\cos\alpha}{d} = \text{constant}$$

where L=length of the plug.

6. Truncated-cone roller according to claim 1, characterized in that everyone of said plugs is formed by a portion of abrasive material and by a support portion releasably inserted in a corresponding seat of the roller wall.

7. A truncated-cone roller according to claim 1, wherein said outer base of the roller is the major base and said inner base is the minor base of the roller when mounted on the working tool.

* * * * *